United States Patent [19]

Vignon

[11] Patent Number: 4,999,884

[45] Date of Patent: Mar. 19, 1991

[54] DRAWING MECHANISM FOR DRAWING TEXTILE FIBERS

[75] Inventor: Louis Vignon, Geneva, Switzerland

[73] Assignee: Maschinenfabrik Rieter AG, Winterthur, Switzerland

[21] Appl. No.: 321,749

[22] Filed: Mar. 10, 1989

[30] Foreign Application Priority Data

Mar. 15, 1988 [CH] Switzerland ..... 978/88

[51] Int. Cl.[5] ..... D01H 5/46

[52] U.S. Cl. ..... 19/266; 19/258; 19/272; 19/288

[58] Field of Search ..... 19/236, 239, 244, 258, 19/266, 281

[56] References Cited

U.S. PATENT DOCUMENTS

| | | | |
|---|---|---|---|
| 2,813,309 | 11/1957 | West et al. | 19/165 |
| 2,815,538 | 12/1957 | Schüssler et al. | 19/266 |
| 2,890,495 | 6/1959 | Miesch et al. | 19/281 |
| 3,303,534 | 2/1967 | Andreani | 19/266 |
| 3,304,584 | 2/1967 | West et al. | 19/258 |
| 4,413,378 | 11/1983 | Mandl et al. | 19/266 |
| 4,510,648 | 4/1985 | Mori et al. | 19/266 |
| 4,512,061 | 4/1985 | Hartsmannsgruber et al. | 19/239 |

FOREIGN PATENT DOCUMENTS

| | | |
|---|---|---|
| 804773 | 12/1951 | Fed. Rep. of Germany . |
| 1156686 | 10/1963 | Fed. Rep. of Germany . |
| 1250315 | 9/1967 | Fed. Rep. of Germany . |
| 2139307 | 2/1973 | Fed. Rep. of Germany . |
| 670169 | 11/1929 | France . |
| 149332 | 10/1967 | U.S.S.R. . |
| 821553 | 4/1981 | U.S.S.R. . |
| 1613 | of 1787 | United Kingdom . |
| 468850 | 7/1937 | United Kingdom . |

*Primary Examiner*—Werner H. Schroeder
*Assistant Examiner*—Michael A. Neas
*Attorney, Agent, or Firm*—Young & Thompson

[57] ABSTRACT

The drawing mechanism for drawing textile fibers includes an input nip between a first pressure roller (6) and a first drafting roller (1), a first intermediate nip between a second pressure roller (7) and a second drafting roller (2), and an output nip between a third pressure roller (8) and a third drafting roller (3). Two additional nips are formed between a fourth and a fifth pressure rollers (9, 10) and the second drafting roller. A second intermediate nip is formed between a sixth pressure roller (11) and the second drafting roller (2). If the treated fibers are short, the draft occurs between the input nip (6 - 1) and the first intermediate nip (9 - 2), and between the second intermediate nip (10 - 2) and the output nip (8 - 3). If the fibers are long, pressure on the fourth and fifth pressure rollers (9, 10) is reduced. The draft zones then extend to the intermediate nips (7 - 2, 11 - 2). In this manner an adaptation to different fiber lengths is possible without alteration of the roller distances.

11 Claims, 2 Drawing Sheets

Figure 1:
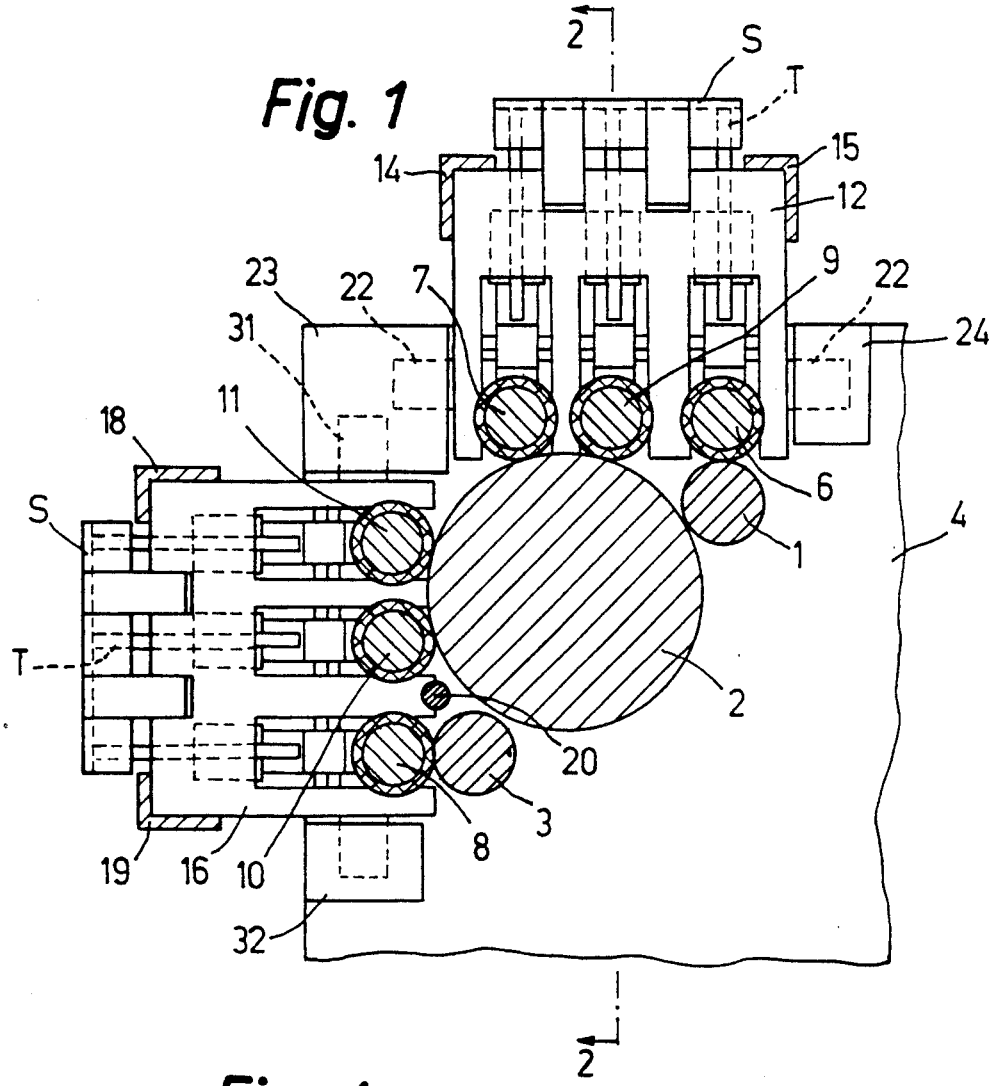

DRAWING MECHANISM FOR DRAWING TEXTILE FIBERS.

The present invention relates to a drawing mechanism for drawing textile fibers which includes an input nip between a first drafting roller and a first pressure roller, at least one intermediate nip between a second drafting roller and a second pressure roller, an output nip between a third drafting roller and a third pressure roller, and means for exerting pressing forces on the pressure rollers, an additional nip with a fourth pressure roller being disposed between the input nip and the intermediate nip, and another additional nip with a fifth pressure roller being disposed between the intermediate nip and the output nip.

A drawing mechanism of this kind has been disclosed, for example, in U.S. Pat. No. 1,782,549. In the latter, the additional nip with the fourth pressure roller serves to hold, in a sliver being treated, the shorter fibers which have left the input nip, until such shorter fibers are grasped by the intermediate nip, whereupon the fibers then slip through the additional nip. For this purpose the fourth pressure roller rotates at the same peripheral speed as the rollers of the input nip In a similar manner the additional nip with the fifth pressure roller serves to hold the shorter fibers in the sliver upstream of the output nip. The distances between the input nip and the intermediate nip, as well as between the intermediate nip and the output nip, are—as in most drawing mechanisms—adjustable so that they can be adapted to the maximum staple length in different slivers to be treated. This adjustability of the drafting rollers and pressure rollers requires, however, a quite complex and expensive construction. In addition, the adjusting operations are also relatively complicated.

It is therefore an object of the present invention to provide a drawing mechanism of the kind referred to in which an adaptation to different staple lengths is possible without adjustment of the distances between the rollers.

In the drawing mechanism according to the invention the said fourth and fifth pressure rollers cooperate with said second drafting roller to form said two additional nips, and said means for exerting pressing forces are adapted to exert on said fourth pressure roller and on said fifth pressure roller pressing forces which are selectively of the same magnitude as or of a lesser magnitude than the pressing forces exerted on said first, said second, and said third pressing rollers.

In the drawing mechanism according to the invention, therefore, the peripheral speeds in the two additional nips are the same as those in said intermediate nip, since these three nips are all defined in common by said second drafting roller. An adaptation to different staple lengths is therefore possible without changing the distances between the nips. If the staple length is less than the distance between the input nip and the adjacent additional nip, or the distance between the output nip and the additional nip adJacent thereto, then the pressing forces exerted on the fourth and on the fifth pressure rollers are adjusted to be substantially equal to the pressing forces exerted on the first, on the second, and on the third pressure rollers. The draft then occurs between the input nip and the neighboring additional nip, and between the other additional nip and the output nip. In addition, an adjustable friction brake member may be provided upstream of the output nip for holding the shorter fibers in the sliver.

If the staple length is greater, and lies between the distance from the input nip to the adjacent additional nip and the distance from the input nip to the intermediate nip (or one of several intermediate nips), then the pressing forces exerted on the fourth and on the fifth pressure rollers are made smaller, so that the draft more or less occurs between the input nip and the intermediate nip, and between the intermediate nip (or one of the intermediate nips) and the output nip. The additional nip upstream of the output nip in this case guides the shorter fibers in the sliver upstream of the output nip.

In both cases the drawing mechanism according to the invention presents the additional advantage that the fibers are drawn out of the input nip not only by the intermediate nip, but also—more or less—by the additional nip arranged upstream of the intermediate nip and rotating at the same speed as the latter. This is particularly important in the case of relatively thick slivers in which the fibers are, before the drafting, not well parallelized.

A sixth pressure roller can also cooperate with the second drafting roller, to form a second intermediate nip. In this case the bearings of the first, the second and the fourth pressure rollers can advantageously be mounted in a first frame, and the bearings of the third, the fifth and the sixth pressure rollers can be mounted in a second frame. To facilitate servicing the two frames can each be pivotable about an axis perpendicular to the axes of the pressure rollers.

Figure 4:
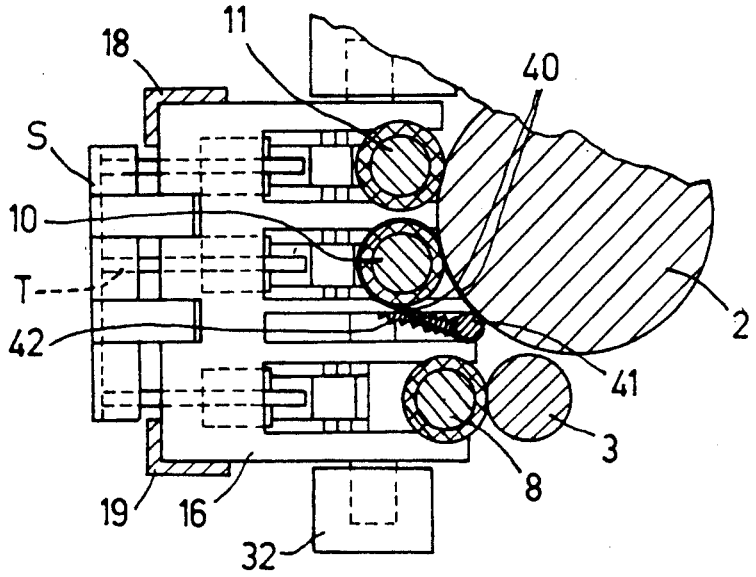
Figure 2:
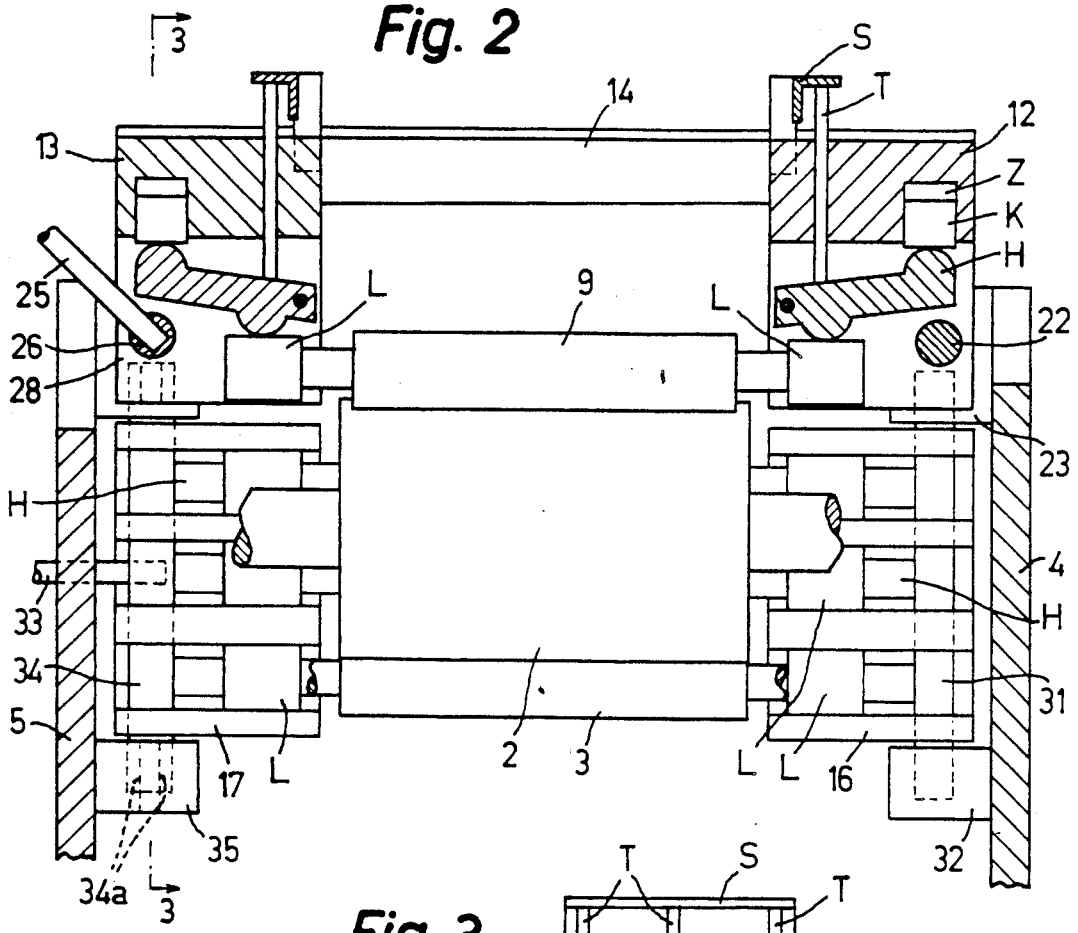
Figure 3:
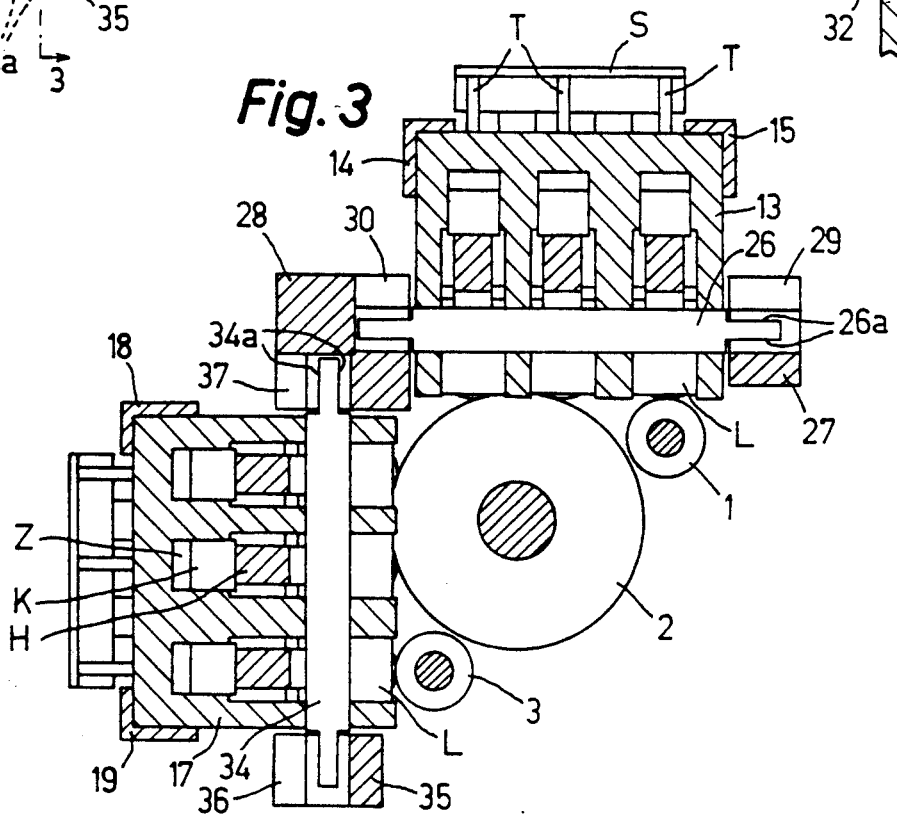

A preferred embodiment of the drawing mechanism according to the invention will now be described in greater detail with reference to the accompanying drawings. In these drawings:

FIG. 1 is a diagrammatic vertical sectional view of a drawing mechanism according to the invention at right angles to the axes of the rollers, FIG. 2 is a diagrammatic sectional view taken on line II—II of FIG. 1, FIG. 3 is a diagrammatic sectional view taken on line III—III of FIG. 2, and FIG. 4 is a view corresponding to a portion of FIG. 1 and showing a modification of a detail.

The drawing mechanism illustrated in the drawings includes three driven drafting rollers 1, 2 and 3 of metal which are journalled, in a manner not shown, in bearings on two side plates 4 and 5 of the mechanism, and six pressure rollers 6, 7, 8, 9, 10, and 11 which are each provided with a rubber sleeve. The first pressure roller 6 and the first drafting roller 1 form an input nip. The second pressure roller 7 and the second drafting roller 2 form an intermediate nip. The third pressure roller B and the third drafting roller 3 form an output nip.

According to the invention an additional nip formed by the fourth pressure roller 9 and the second drafting roller 2, is disposed between the input nip (6 - 1) and the intermediate nip (7- 2) Another additional nip, formed by the fifth pressure roller 10 and the second drafting roller 2, is disposed between a second intermediate nip, which is formed by the sixth pressure roller 11 and the second drafting roller 2, and the output nip (8 - 3).

The diameter of the second drafting roller 2 is about two to four times the diameter of the first drafting roller 1 and of the third drafting roller 3. In the illustrated drawing mechanism a sliver to be drafted passes through substantially three zones, namely a preliminary drafting zone which extends from the input nip (6 - 1) to the first additional nip (9 - 2) or to the first intermediate nip (7 - 2), a neutral zone between the first intermediate nip (7 - 2) and the second intermediate nip (11 - 2), and a main drafting zone which extends from the second additional nip (10 - 2) or from the second intermediate nip (11 - 2) to the output nip (8 - 3).

The bearings L of the first, the second and the fourth pressure rollers 6, 7 and 9, respectively, are mounted in a bridge-shaped frame comprising two side blocks 12 and 13 joined to each other by two angle bars 14 and 15. Similarly, the bearings L of the third, the fifth and the sixth pressure rollers 8, 10 and 11, respectively, are mounted in a second bridge-shaped frame comprising two side blocks 16 and 17 joined to each other by two angle bars 18 and 19.

Each one of the blocks 12, 13, 16 and 17 includes, for each bearing L mounted therein, a cylinder Z with a piston K which acts on the respective bearing L by means of a force amplifying lever H, to press the respective pressure roller against the associated drafting roller. It will of course be understood that lever H amplifies the pressing force of piston K as applied to bearing L, according to the ratio of the arms of lever H. By virtue of the amplification of the pressing force by the levers H it is possible to operate the cylinders Z with compressed air, and thereby to exert the required pressing force on the pressure rollers in spite of the limited diameter of the cylinders Z. The compressed air supply lines to the cylinders Z are not shown in the drawings. These compressed air supply lines include adjusting means, likewise not shown, which are adapted to supply equal pressures to all the cylinders Z, for exerting pressing forces of equal magnitude on all the pressure rollers 6, 7, 8, 10 and 11, if the length of the fibers in the sliver being treated in the drawing mechanism is less than the distance between the input nip (6 - 1) and the first additional nip (9 - 2) or the distance between the second additional nip (10 - 2) and the output nip (8 - 3). In this case the draft of the sliver occurs between the input nip (6 - 1) and the first additional nip (9 - 2), and between the second additional nip (10 - 2) and the output nip (8 - 3). A friction brake element 20 (FIG. 1), adjustable transversely to the sliver, may be arranged between the second additional nip (10 - 2) and the output nip (8 - 3) for somewhat retaining the shorter fibers in the fiber mixture of which the sliver is comprised. Instead, and as shown in FIG. 4, it is also possible to use, for guiding the fibers between the second additional nip (10 - 2) and the output nip (8 - 3), an endless guide belt 40 which surrounds the fifth pressure roller 10 and a small guide roller 41. The guide roller 41 is journalled at its two ends in bearings (not shown) which are mounted in blocks 16 and 17. An adjusting screw 42 acts on each one of these bearings. By adjusting the two screws 42 it is possible to alter the magnitude of the force by which the guide belt 40 is tensioned by the roller 41, and pressed against the drafting roller 2.

If the length of the fibers is greater, and lies between the distance from the nip (6 - 1) to the nip (9 - 2) (or from 10 - 2 to 8 - 3) and the distance from the nip (6 - 1 to the nip (7 - 2) (or from 11 - 2 to 8 - 3), then the pressure supplied to the cylinders Z associated with the pressure rollers 9 and 10 is reduced with the aid of the said adjusting means, so that the pressing forces exerted on the pressure rollers and 10 are now smaller than the pressing forces exerted on the pressure rollers 6, 7, 11 and 8. The draft of the sliver then more or less occurs between the nip (6 - 1) and the nip (7 - 2), and between the nip (11 - 2) and the nip (8 - 3).

Plungers T are slidably mounted in the blocks 12, 13, 16 and 17, each plunger T being associated with one of the bearings L. The plungers T are in engagement with the respective bearing L or with its actuating lever H. If a lap up forms on one of the rollers, then at least one of the plungers T will thereby be displaced.

Three of the plungers T are mounted in each one of the blocks 12, 13, 16 and 17, the free ends of the three plungers T being in contact with a common switch actuating bar S which is pivotably mounted on the respective block. Each switch actuating bar S, if pivoted from the illustrated rest position by one of the plungers T, actuates a switch (not shown) for switching the drawing mechanism off. The drawing mechanism is thus automatically switched off as soon as any one or several of the plungers T are displaced by the formation of a lap up.

The block 12 of the first frame 12, 13, 14, 15 is pivotably mounted on a shaft 22 which is supported in two carrying blocks 23 and 24 secured to the mechanism side plate 4. A shaft 26, pivotable by means of a lever arm 25 (FIG. 2), is journaled in block 13. The shaft 26 has end portions provided with diametrically opposite flats **26*a* (FIG. 3) extending into keyhole-shaped recesses in bearing blocks 27 and secured to the mechanism side plate 5. In the illustrated position of the shaft 26 the end portions thereof are retained in the wide portions of the keyhole-shaped recesses. The frame 12, 13, 14, 15 is thereby locked in its illustrated working position. If, however, the shaft 26 is pivoted by 90°, its end portions can, by virtue of the flats 26*a*, pass through the upwardly open slots 29 and 30 of the keyhole-shaped recesses. The frame 12, 13, 14, 15 can therefore be pivoted upwards about the shaft 22 to make the drafting rollers 1, 2 and the pressure rollers 6, 7 and 9** accessible.

In a similar manner the block 16 of the second frame 16, 17, 18, 19 is pivotably mounted on a shaft 31 which is supported in the carrying block 23 and in a further carrying block 32 secured to the mechanism side plate 4. And a shaft 34, pivotable by means of a lever arm 33 (FIG. 2), is journaled in block 17. The shaft 34 has end portions with diametrically opposite flats **34*a* which extend into keyhole-shaped recesses in bearing block 28 and in a further bearing block 35 secured to the mechanism side plate 5. After pivoting the shaft 34 by 90° its end portions can, by virtue of the flats 34*a*, pass through the laterally open slots 36 and 37 of the keyhole-shaped recesses so that the frame 16, 17, 18, 19 can then be pivoted about the shaft 31**.

What is claimed is:

1. A drawing mechanism for drawing textile fibers including:

an input nip between a first drafting roller and a first pressure roller, at least one intermediate nip between a second drafting roller and a second pressure roller, an output nip between a third drafting roller and a third pressure roller, and an arrangement for exerting pressing forces on the pressure rollers, an additional nip with a fourth pressure roller being disposed between said input nip and said intermediate nip, and another additional nip with a fifth pressure roller being disposed between said intermediate nip and said output nip, wherein said fourth pressure roller and said fifth pressure roller both cooperate with said second drafting roller to form said two additional nips, and wherein said arrangement for exerting pressing forces includes means selectively to exert on said fourth pressure roller and on said fifth pressure roller pressing forces of the same magnitude as the pressing forces exerted on said first, said second and said third pressure rollers, or pressing forces of lesser magnitude than the pressing forces exerted on said first, said second and said third pressure rollers.

2. A drawing mechanism as claimed in claim 1 wherein said second drafting roller has a larger diameter than said first and said third drafting rollers.

3. A drawing mechanism as claimed in claim 2 wherein the diameter of said second drafting roller is from two to four times the diameter of said first and said third drafting rollers.

4. A drawing mechanism as claimed in claim 1 and further comprising a sixth pressure roller cooperating with said second drafting roller to form a second intermediate nip.

5. A drawing mechanism as claimed in claim 4 wherein said first, said second and said fourth pressure rollers are provided with bearings mounted in a first frame, and said third, said fifth and said sixth pressure rollers are provided with bearings mounted in a second frame.

6. A drawing mechanism as claimed in claim 5 wherein said first and said second frames include, for each one of said pressure roller bearings, a plunger movable in response to a displacement of the respective pressure roller bearing, for moving a switch actuating member common to three pressure roller bearings mounted in the same one of said frames.

7. A drawing mechanism as claimed in claim 5 wherein each one of said frames is pivotable about a stationary axis, and includes means for locking the frame in a working position.

8. A drawing mechanism as claimed in claim 7 wherein said means for locking each frame in said working position include pivotable shafts journalled in each one of said frames and having end portions with diametrically opposite flats extending into keyhole-shaped recesses provided in stationary bearing blocks, said recesses having a relatively wide closed end and a relatively narrow open end.

9. A drawing mechanism as claimed in claim 1 wherein said pressure rollers are provided with bearings and wherein said arrangement for exerting pressing forces includes, for each one of said bearings, a pneumatic cylinder acting on the respective bearing by way of a force amplifying lever arm for amplifying the pressing force according to a ratio of its lever arms.

10. A drawing mechanism as claimed in claim 1 and further comprising an adjustable friction braking member for said fibers arranged in the direction of fiber movement to contact said fibers before said fibers reach said output nip.

11. A drawing mechanism as claimed in claim 1 and further comprising an endless belt surrounding said fifth pressure roller and a guide roller disposed between said fifth pressure roller and said output nip, said guide roller tensioning said endless belt and pressing said belt against said second drafting roller with an adjustable force.

* * * * *